US006729968B2

(12) United States Patent
Port et al.

(10) Patent No.: US 6,729,968 B2
(45) Date of Patent: May 4, 2004

(54) PUTTING TRAINING AID AND CALIBRATION DEVICE

(76) Inventors: Richard M. Port, 204 Northampton La., Lincolnshire, IL (US) 60069; John M. Andrews, 142 Crisfield Dr., Grayslake, IL (US) 60030

( * ) Notice: Subject to any disclaimer, the term of this patent is extended or adjusted under 35 U.S.C. 154(b) by 0 days.

(21) Appl. No.: 10/160,423

(22) Filed: May 31, 2002

(65) Prior Publication Data

US 2003/0224868 A1 Dec. 4, 2003

(51) Int. Cl.[7] ..... A63B 69/36
(52) U.S. Cl. ..... 473/261; 473/296
(58) Field of Search ..... 473/261, 258, 473/264, 265, 260, 257, 296, 295, 256, 238, 251, 253, 254

(56) References Cited

U.S. PATENT DOCUMENTS

| | | | | | |
|---|---|---|---|---|---|
| 1,943,066 | A | * | 1/1934 | Ford | 473/239 |
| 3,214,169 | A | * | 10/1965 | Rupnow | 473/246 |
| 3,953,035 | A | * | 4/1976 | Beckisk | 473/229 |
| 4,468,034 | A | * | 8/1984 | Duclos | 473/242 |
| 4,620,708 | A | | 11/1986 | Meyer et al. | 273/192 |
| 4,736,952 | A | * | 4/1988 | Taft et al. | 473/218 |
| 4,852,881 | A | | 8/1989 | Bellagamba et al. | 273/183 B |
| 4,869,510 | A | * | 9/1989 | Battersby | 473/264 |
| 4,900,030 | A | * | 2/1990 | Houtz | 473/258 |
| 5,332,211 | A | * | 7/1994 | Rife et al. | 473/258 |
| 5,423,548 | A | * | 6/1995 | Bricker | 473/258 |
| 5,433,445 | A | * | 7/1995 | Melancon | 473/261 |
| 5,480,151 | A | * | 1/1996 | Adams | 473/238 |
| 5,586,945 | A | | 12/1996 | Vonderhaar | 473/258 |
| 5,595,543 | A | | 1/1997 | Wolk | 473/162 |
| 5,769,732 | A | * | 6/1998 | O'Neal | 473/258 |
| 6,159,106 | A | | 12/2000 | Adams | 473/265 |
| 6,623,372 | B1 | * | 9/2003 | Beebe et al. | 473/231 |

* cited by examiner

*Primary Examiner*—Gregory Vidovich
*Assistant Examiner*—Nini F. Legesse
(74) *Attorney, Agent, or Firm*—Edward J. Chalfie; Ladas & Parry

(57) ABSTRACT

A putting training aid and putter calibration device for use on a putting surface is disclosed which includes a horizontal calibrated bar with a linear centered scale and a parallel calibration block having an oblique face and set on the practice putting surface below and offset from the horizontal calibrated bar. Also provided is a linear scale decal which is applied to a putter shaft. The device is designed to align the putter head to proper lie and neutral loft so that the face is square to the intended target line and to teach the golfer the proper grip, stance, alignment of the golfer, alignment of the club and proper putting stroke.

5 Claims, 4 Drawing Sheets

PUTTING TRAINING AID AND CALIBRATION DEVICE

BACKGROUND OF THE INVENTION

This invention relates generally to golf training aids, and more particularly to training aids dealing with that part of the golf game referred to as putting. Training aids are commonly used in the game of golf to assist the golfer to improve a particular aspect of the golfer's game. These can be used for self improvement or with the assistance of a professional golf instructor. The present invention is intended to improve the putting portion of the golf game and can also be used to assist in the selection of the putter best suitable for a given golfer's style of putting stroke.

Prior putting aids have failed to assist the golfer in proper club selection. Additionally, past training aids have used a subjective approach to correction of the stroke without using or establishing objective criteria. This invention can objectively calibrate the loft and lie of the putter. The loft of the putter face is defined as the angle between the club face and the vertical plane. The lie angle is defined as the angle between the club shaft center line and the horizontal plane. This invention is intended to provide the golfer with objective measurement criteria, which, when incorporated into the golfer's game through adjustment of the loft, horizontal and vertical positioning of the putter, the golfer should achieve more consistent putting performance. The invention, when used in accordance with its instructions, is intended to provide an aid for the development of a reproducible putting stroke that is consistently on line with the intended target. The training aid will afford the user the opportunity to achieve sustainable positive putting results.

SUMMARY OF THE INVENTION

In order to consistently and accurately put a golf ball on a putting surface, the putter's face should be square to the intended target and the putter's sole should be parallel to the putting surface.

If the sole is not parallel to the surface, the toe or the heel of the putter could drag on the putting surface. If the toe drags the putter can pivot on the toe and tend to "push" the ball away from the golfer. On the other hand if the heel drags, the putter can pivot on the heel and tend to "pull" the ball toward the golfer. In either case the result is a putter face which is vertically out of square with the intended target line.

If the putter face has other than 0° loft on contact with the ball, the putter striking the ball will tend to lift the ball and divert it from a true path toward the intended target.

The present invention allows the golfer to establish a neutral position for the putter at contact with the ball with respect to both loft and lie. In this manner, the golfer can determine if a particular putter, with its loft and lie, comfortably suits the golfers putting stance and putting style.

The training and the calibration aid embodying the present invention includes a frame supporting a horizontal calibration bar. The calibration bar has a calibration scale applied to the bar on a decal or similar application. The calibration scale has a zero point and may be marked with position notations suitable for the individual golfer. A calibration block, having an orthogonal face is positioned below and offset from the calibration bar on the putting surface.

In calibration mode operation, the putter is balanced against the calibration bar, with the sole of the putter head aligned to the putting surface. The putter face may then be leaned against the orthogonal face of the calibration block to square the face on the intended target line. The resulting position of the putting handle may be then marked on the calibration decal on the horizontal calibration bar and on a similar calibration decal applied to the putter's shaft. These markings determine a repeatable set up position for the putter with close to zero loft. In the practice mode, the calibration block is removed and the putter is placed so that the calibration marks are aligned for the optimum setup position. The golfer then grips the puffer and practices a puffing stroke guided by the horizontal calibration bar so that the golfer becomes comfortable with the setup position and the correct, repeatable putting stroke.

It is an object of the present invention to provide a golf training aid to improve putting performance through proper horizontal alignment of the putter and providing the user with an objective measurement indicator to maintain horizontal alignment.

It is a further object of the present invention to provide a golf training aid to improve putting performance through proper vertical alignment of the putter shaft and providing the user with an objective measurement indicator to maintain vertical alignment.

It is another object of the present invention to provide a golf training aid to improve putting performance through proper alignment of the putter club face to the target line and providing the user with an objective measurement indicator to maintain putter club face alignment.

It is yet another object of the invention to provide a golf training aid to improve putting performance through the use of a horizontally supported guide rail above and offset from the intended target path to which the putter remains in contact throughout the practice putting stroke.

DESCRIPTION OF THE DRAWING FIGURES

DESCRIPTION OF THE PREFERRED EMBODIMENT

Figure 1:
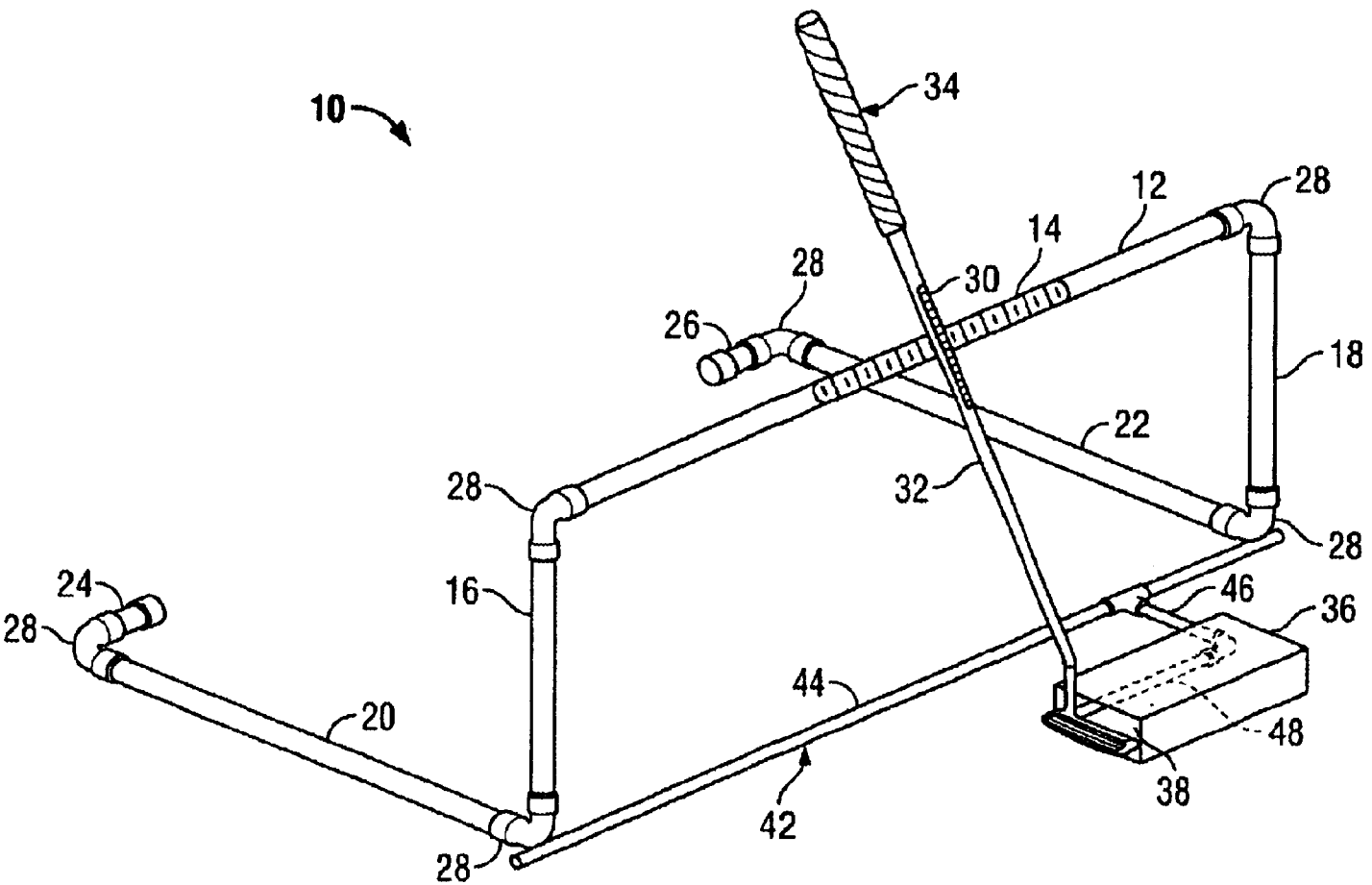
FIG. 1 is a general perspective view of the training aid embodying the present invention including the putter face calibration block and an exemplary putter.

Referring now to the drawings, and particularly to FIG. 1 thereof, there is shown the preferred embodiment of the training aid 10 according to the present invention, which includes the horizontal crossbar 12 with calibration scale 14, vertical support bars 16 and 18, horizontal legs 20 and 22 and stabilizing extensions 24 and 26. The horizontal crossbar, vertical support bars, horizontal legs and stabilizing extensions are attached to each other with elbow connectors 28.

Also shown in FIG. 1 is calibration block 36 which includes calibration face 38 which is orthogonal to the putting surface 40 when block 36 is placed thereon. Calibration block 36 is fixed in position relative to horizontal cross bar 14 by spacer jig assembly 42 which includes spacer arm, which in calibration models designed to abut the bases of legs 16 and 18. Spacer extension 46 and spacer bar 48 (shown in phantom) gauges the proper offset distance from the crossbar to the calibration block on the putting surface and ensures that the calibration block is placed parallel to the cross bar so the putter face is not open or closed during the loft calibration process. Located on the puffing surface, is ball spot 44 which indicates the position, beneath the calibration block, of the center resting point of an imaginary golf ball whose trailing edge is tangential with the orthogonal calibration face of the calibration block. In other words, the point at which a golf ball would be placed to be in contact with the face of the putter when it is in position to be aligned with the orthogonal face of the calibration block.

The invention in its preferred embodiment has a horizontal crossbar 12 measuring 32 inches in length supported by two vertical support bars 16 and 18, each measuring 18 inches in height. In one embodiment, all of the tubular component of the calibration frame are lengths of PVC pipe. Calibration decal 14 has a mark indicating the center point of the calibration bar and indicating regular demarcations on either side of the center point. A second linear calibration decal 30 is affixed to the shaft 32 of the putter 34.

The balanced stand-alone position is defined as the position of the putter when it lays vertically against the device crossbar with the proper lie angle and the head of the putter perpendicular to the crossbar. This position is achieved by placing the shaft of the putter on the large center arrow marked on the cross bar so that it is balanced and will stand alone.

The head of the putter should be perpendicular to the cross bar so that the face of the putter is not open or closed in relation to the putting plane and target line. Each putter has a unique lie angle. The lie angle is defined as the angle of the shaft in relation to the sole or bottom of the putter head. In order to have the proper lie angle, the sole of the putter head must have maximum contact with the putting surface while the shaft of the putter is in contact with the crossbar of the device.

Figure 2:
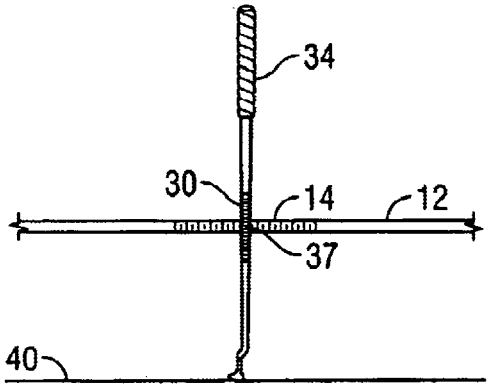
FIG. 2 is a front plan view of the putter shaft perpendicular to the horizontal calibration bar with the sole of the putter resting on the putting surface.
Figure 3:
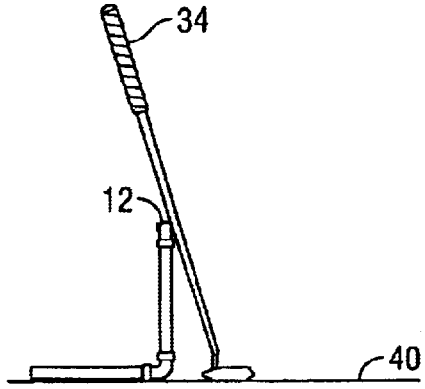
FIG. 3 is a side view of the putter shaft depicting the angle of the shaft relative to the bar when the sole of the putter is in maximum contact with the putting surface.

FIG. 2. illustrates the balanced stand-alone position of the putter from a front view, with the putter aligned at the center mark of the calibration scale 14 and the sole of the putter resting in maximum contact with the horizontal putting surface 40, as more readily seen in FIG. 3. For some putters with flat soles the contact will extend along the length of the sole. When the putter is set at the balanced stand-alone position a mark 37 is placed on calibration decal 30 on shaft 32 of the putter 34 to correspond to the point of contact of the putter shaft to crossbar 12.

Putters can have different lofts like any other golf club. The putter should be calibrated so that the golfer's hands can be placed in a repeatable position to insure that the ball is struck with a flat putter surface and close to zero loft. Once the player has mastered striking the ball with a fiat putter surface, the hand position can be changed purposely to alter the loft of the putter if desired. The following steps are used to calibrate the putter face:

1. Placing the loft-calibrating block so that the face of the block is flush with bottom of the face of the putter in the stand-alone balanced position. If the putter has loft there will be visible space between the top of the face of the putter and the top of the block.

2. Holding the calibrating block with the right hand, gently slide the shaft of the putter with the left hand to the right along the crossbar until the entire putter face is flush with the loft calibration block.

Figure 4:
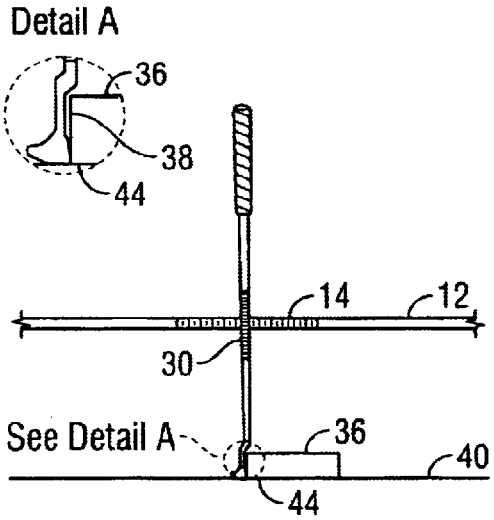
FIG. 4 is a front view of the putter shaft resting on the horizontal calibration bar with the sole of the putter resting on the putting surface with the putter's loft angle presenting a gap to the face of the calibration block.
Figure 5:
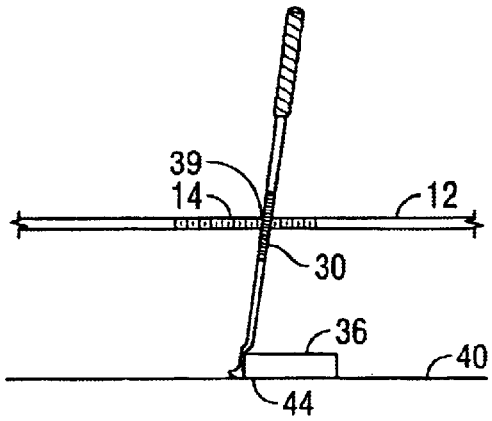
FIG. 5 is a front view of the putter shaft resting on the horizontal calibration bar with the sole of the putter resting on the putting surface with the putter leaned into the calibration block and the face of the putter flush with the face of the calibration block.

Initially, with the putter shaft placed at the zero point on the calibration scale 14, the face of the putter is not flush to the calibration block (FIG. 4 Detail A). As the putter shaft is aligned so that the club face of the putter is flush with the vertical face of the calibration block, the shaft of the putter is moved to either right or left of the center point on the calibration bar. As 0° loft angle is the preferred hitting position, the realigned calibration point is an objective measurement, which can be repeated during golf play to achieve optimal putting results. When the putter is set up in the optimum position shown in FIG. 5, the golfer can determine if the particular putter is comfortable in the golfer's hands. This is governed, in large part, by the loft and lie of the putter, on the one hand, and the physique, stance and putting style of the golfer, on the other. When the putter is set at the 0° position a mark 39 is placed on calibration decal 14 on crossbar 12 to correspond to the point of contact of the putter shaft to crossbar 12.

Once the shaft has been placed in the close to zero loft position, the golfer identifies the horizontal shaft position on the calibrations of the crossbar. The shaft position will be different for each putter specification, but will always be the same for the individual putter.

The vertical height of the shaft should remain constant to insure stability of the lie angle of the putter. The golfer identifies the vertical shaft position on the crossbar by the calibration decal on the putter shaft.

Figure 6:
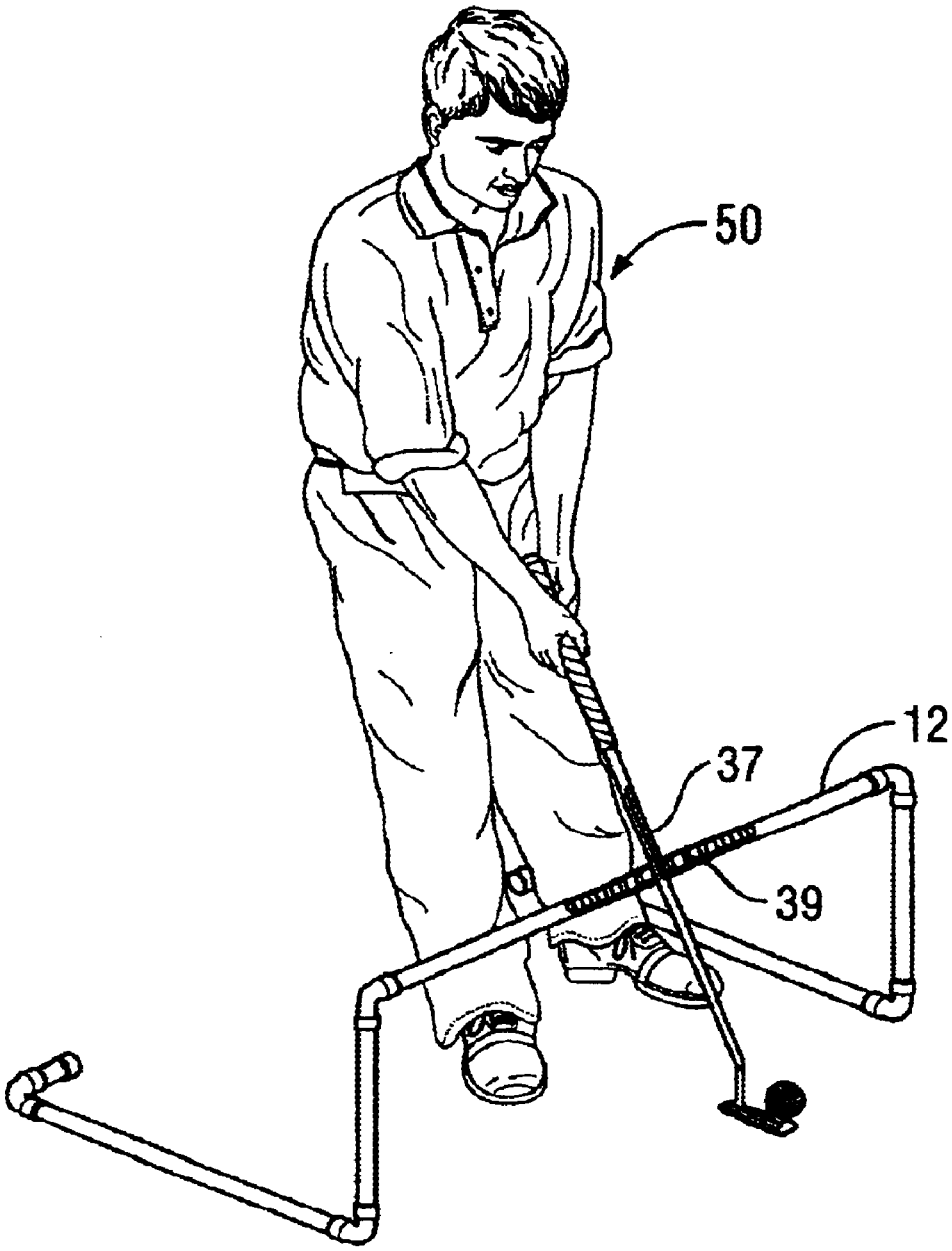
FIG. 6 is a general perspective view of a golfer using the training aid of the present invention to practice his putting stroke.
Figure 7:
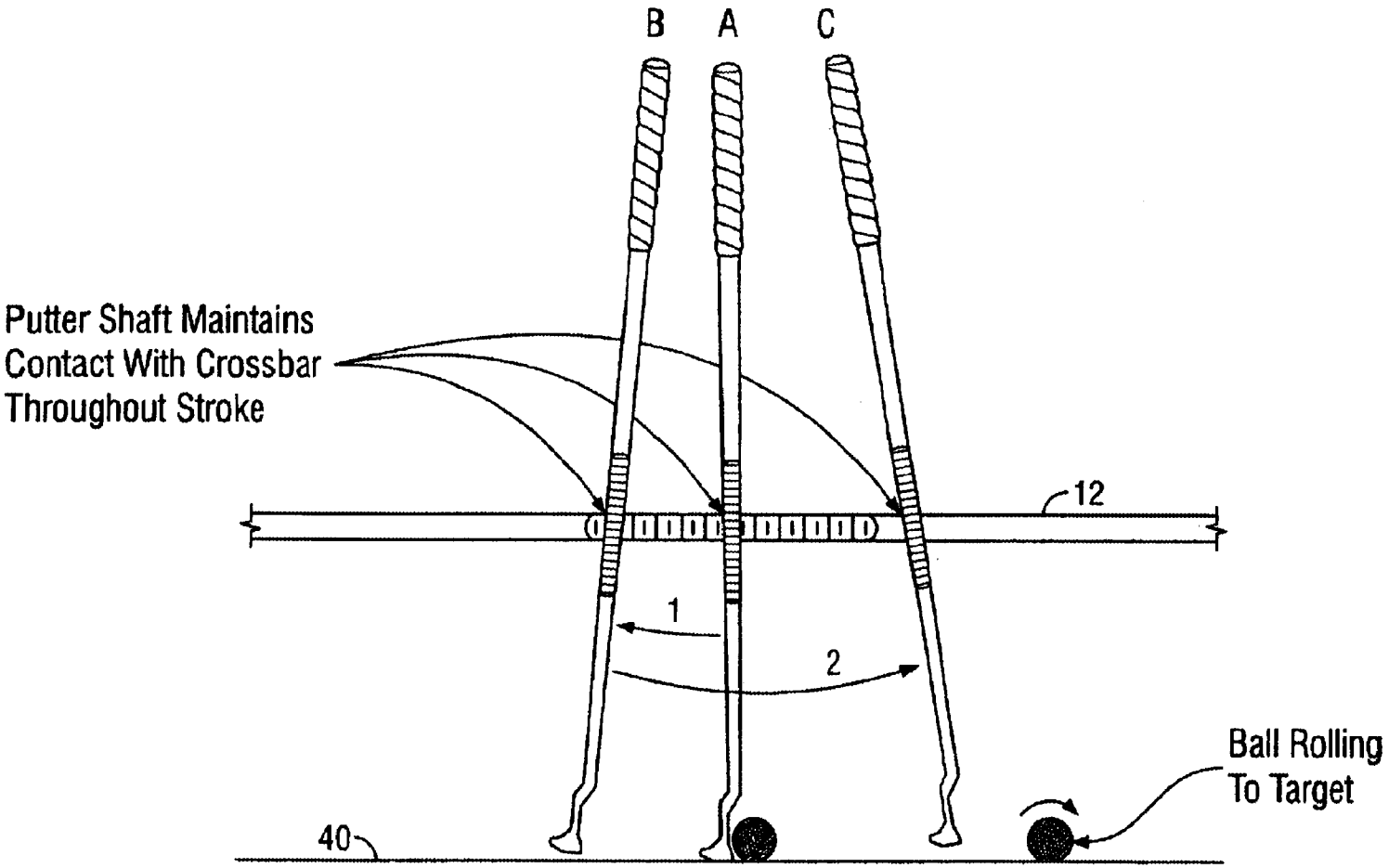
FIG. 7 is a partial front view of the calibration bar of the present invention in practice mode with three positions of the putting stroke shown.

In FIG. 6, A golfer 50 is shown practicing putting with the help of the putting aid embodying the present invention. In this practice mode, the golfer aligns the putter on crossbar 12 with mark 37 on putter shaft scale 30 aligned with mark 39 on crossbar scale 14 and the practice golf ball placed on spot 44. This is the position determined by the prior calibration procedure so that the putter face is now square to the intended target line which is parallel to the crossbar 12. As shown in FIG. 7, the practice stroke begins at position A in the calibrated putter position as determined by the prior calibration, transitions through back swing 1 to position B, then proceeds through swing arc 2 through initial position A, making contact with the practice ball, to follow through position C. Throughout the stroke, the club shaft maintains contact with crossbar 12 so that the golfer can practice a consistent planar stroke.

After the putter face has been aligned properly in the close to zero loft position, the shaft position on the crossbar can be calibrated.

A square position of the putter face (perpendicular to the cross bar) is key to starting the ball on the desired path. Even with proper usage of the training device, an open or closed putter face will result in a ball rolling right or left of the target line. In order to align the putter face with the device and intended target line it is necessary to make sure that the calibration block is parallel to the crossbar and the intended target line.

While a preferred embodiment of the invention has been disclosed in detail, it should be understood by those skilled in the art that various modifications can be made to the illustrated embodiment without departing from the scope of the invention as described in the specification and hereafter defined in the appended claims.

What is claimed is:

1. A putting training aid and calibration device for use on a substantially horizontal and planar putting surface, for use in calibrating a putter having a shaft and a head, with said head having a sole and a face, with said sole and said shaft defining a lie angle and with said face, and said shaft defining a loft angle, the training aid and calibration device comprising:

an elongated rigid calibration member having a first end and a second end and supported above and parallel to the putting surface;

a first linear scale indicated on said calibration member intermediate said first end and said second end;

a second linear scale affixed to said shaft;

wherein said lie angle is determined by resting said puffer shift on said elongated rigid calibration member, in contact with said first linear scale and by parallelly placing said sole on the puffing surface; and;

wherein said loft angle is determined by resting said puffer shaft on said elongated rigid calibration member in contact with said first linear scale, and by orthogonally aligning said head face to the putting surface.

2. A putting training aid and calibration device, as in claim 1, further comprising a calibration block, configured to rest on the putting surface in parallel alignment with said calibration member, on an intended target line, and having calibration face which is orthogonally aligned to the putting surface and to said intended target line when said block rests on the putting surface; and said loft angle being determined by resting said shaft on said elongated rigid calibration member in contact with said first linear scale, and by positioning said head face flush against said orthogonal calibration face.

3. A putting training aid and calibration de vice, as in claim 2, further comprising:

a pair of substantially vertical legs supporting said calibration member; and a spacer structure fixedly positioning the location of said calibration block on the putting surface in parallel alignment with said calibration member on said intended target line.

4. A putting training aid and calibration device, as in claim 1, wherein said first linear scale has a zero point mark intermediate said first end and said second end, with sequentially marked values extending laterally toward each of said first and second ends.

5. A puffing training aid and calibration device, as in claim 1, wherein said elongated calibration member is supported at least eighteen inches above said putting surface.

* * * * *

UNITED STATES PATENT AND TRADEMARK OFFICE

CERTIFICATE OF CORRECTION

PATENT NO. : 6,729,968 B2
APPLICATION NO. : 10/160423
DATED : May 4, 2004
INVENTOR(S) : Richard M. Port et al.

It is certified that error appears in the above-identified patent and that said Letters Patent is hereby corrected as shown below:

In the drawings, Sheet 3, Figure 6, the lead lines for reference numbers 37 and 39 should be moved to point to the aligned marks on the respective putter shaft and crossbar scales;

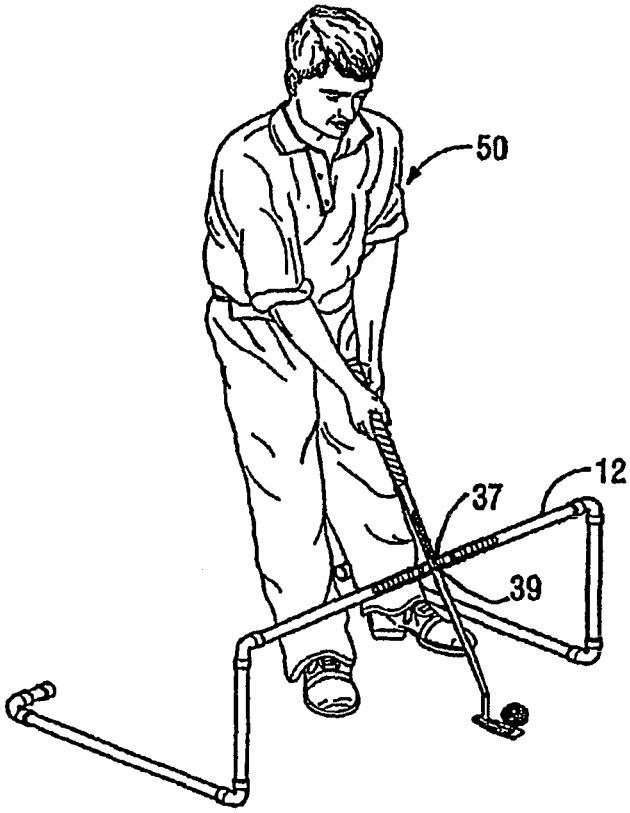

FIG. 6

In column 2, line 11, delete “puffer” and insert --putter--;
In column 2, line 12, delete “puffing” and insert --putting--;
In column 3, line 19, delete “puffing” and insert --putting--;
In column 5, line 21-22, delete “puffer shift” and insert --putter shaft--;
In column 5, line 24, delete “puffing” and insert --putting--;

UNITED STATES PATENT AND TRADEMARK OFFICE

CERTIFICATE OF CORRECTION

PATENT NO. : 6,729,968 B2
APPLICATION NO. : 10/160423
DATED : May 4, 2004
INVENTOR(S) : Richard M. Port et al.

It is certified that error appears in the above-identified patent and that said Letters Patent is hereby corrected as shown below:

In column 5, line 24, after "; and" delete ";";
In column 5, line 26, delete "puffer" and insert --putter--;
In column 6, line 2 after "comprising" insert --:--;
In column 6, line 4 after " having " insert -- a --;
In column 6, delete lines 1-11 and insert the same claim language in the following format:

--2 . A putting training aid and calibration device, as in claim 1, further comprising:

a calibration block, configured to rest on the putting surface in parallel alignment with said calibration member, on an intended target line, and having a calibration face which is orthogonally aligned to the putting surface and to said intended target line when said block rests on the putting surface; and said loft angle being determined by resting said shaft on said elongated rigid calibration member in contact with said first linear scale, and by positioning said head face flush against said orthogonal calibration face.--

In column 6, line 12, delete "de vice" and insert --device--;
In column 6, line 25, delete "puffing" and insert --putting--.

Signed and Sealed this

Seventh Day of November, 2006

JON W. DUDAS
*Director of the United States Patent and Trademark Office*